United States Patent [19]

Schwartz-Domke et al.

[11] 3,938,582

[45] Feb. 17, 1976

[54] ARRANGEMENT FOR CONTINUOUS MANUFACTURE OF METAL INGOTS IN A MOLD WITH OPEN BOTTOM

[75] Inventors: Wolfgang Schwartz-Domke, Bornheim-Roisdorf; Helmut Gröf, Bruchkobel; Anton Wamser, Hanau am Main, all of Germany

[73] Assignee: Leybold Heraeus GmbH & Co. KG, Cologne, Germany

[22] Filed: Sept. 12, 1974

[21] Appl. No.: 505,485

[30] Foreign Application Priority Data

Sept. 13, 1973 Germany ..... 2346038

[52] U.S. Cl. ..... 164/252

[51] Int. Cl.[2] ..... B22D 27/02

[58] Field of Search ..... 164/52, 82, 252, 274, 282, 164/73

[56] References Cited

UNITED STATES PATENTS

| | | | |
|---|---|---|---|
| 2,711,955 | 6/1955 | Jordan | 164/82 X |
| 3,835,916 | 9/1974 | Ujiie | 164/252 |

*Primary Examiner*—Francis S. Husar
*Assistant Examiner*—John E. Roethel
*Attorney, Agent, or Firm*—Joseph F. Padlon

[57] ABSTRACT

An arrangement for the continuous manufacture of metal ingots by progressive crystallization below a slag layer in a mold open at the bottom. Below the bottom edge of the mold, there are distributed along the periphery of the mold, several blocking elements moveable in the direction of the ingot surface. The edges and surfaces facing the ingot are adapted to the shape of the ingot cross section, and the blocking elements may be sectors of an annular ring.

11 Claims, 2 Drawing Figures

ARRANGEMENT FOR CONTINUOUS MANUFACTURE OF METAL INGOTS IN A MOLD WITH OPEN BOTTOM

BACKGROUND OF THE INVENTION

The present invention concerns a device for the continuous manufacture of metal ingots by progressive crystallization underneath a slag layer in a mold open at the bottom.

A large number of such devices is known in the art. They are used for the manufacture of metal ingots whose length is greater than the length of the casting mold. An example is the so-called electro-slag remelting process. Here one or more melt-off electrodes are remelted continuously by a molten slag layer whose area of contact with the slag layer constitutes a melt pool of varying depth. Melt-off electrodes, liquid slag and the crystallizing ingot are contained within a cylindrical or slightly conic liquid-cooled mold whose bottom consists of the ingot. The continuous operation can be maintained by uniform or stepwise drawing-off of the ingot in the downward direction with the mold at rest or by raising the mold with the ingot at rest. The melt-off electrodes are fed into the slag layer as they are consumed. The heat of fusion (melting heat) is produced by the current flow between the melt-off electrodes and the ingot through the slag layer.

The state of the art also includes another method where the temperature of the slag layer is maintained by permanent electrodes. The metal required for crystallizing the ingot is poured in the melted state through the slag layer. Such methods are designated as bottom slag foundry methods. Naturally, combinations of the two methods are conceivable.

Crystallization of the ingot inside the mold is caused by continuous heat withdrawl by cooling agents which are circulated within a hollow space in the mold. Other cooling locations are the ingot surface already protruding from the mold, and the area of contact of the ingot with a similarly cooled base. At the start of the crystallization process, this base also constitutes the lower terminal surface of the mold. As a result, there is an appreciable temperature gradient between the melted zone and the bottom edge of the mold. Because of the laws of physics, this results in an appreciable transverse contraction of the ingot increasing in the downward direction. Hence the ingot, viewed lengthwise, has a slightly conical shape. The increasing contraction appreciably impairs the sealing action of the ingot which, according to the above, constitutes the lower breech of the mold.

It is possible to provide limited compensation by a suitable conic shape of the mold. However, because of the rigidity of the mold possible time variations in the contraction are beyond control. Similarly, in the same melting device, different alloys must be remelted which result in different melting parameters with other consequences during the course of the process. Again, the rigidity of the device design does not permit an arbitrary adaptation to the changed melting parameters. It is also possible that through irregularities in the melting process there occur disturbances caused by the fact that appreciable quantities of slag and/or metal pass through the annular gap between mold and ingot into the space below. Among these are, for example, the local overheating of the slag, migration of the liquid-solid boundary of the melt, and cracks in the slag layer forming at the surface of the mold and on the ingot surface. Aside from the fact that this may endanger personnel and damage the device, such an occurrence will in most cases interrupt the melting process which then cannot be started again. The result is that that section of the ingot produced at high cost must be rejected or be used for inferior purposes.

A time-wise change of the temperature profile in the mold will appear very frequently with the so-called "hot topping" phase. As is well known, "hot topping" plays a considerable part in the manufacture of ingots, because only in this manner is it possible to eliminate or reduce the formation of faults in the ingot part produced last. Through "hot topping" a liquid phase will be maintained as long as possible in the center of the ingot surface during continuous, but reduced supply of liquid metal. Otherwise, head contraction cavities might form which would lead to the rejection of an appreciable part of the upper ingot end. As a result of the reduced heat inflow during this part of the process, the transverse contraction of the ingot even increases. Hence the annular gap is enlarged and the danger of a breakthrough of slag and/or molten metal increases. With larger ingot diameters there may easily appear an annular gap several centimeters wide causing considerable problems with respect to prevention of run-out of slag or molten metal. The difficulties are increased if the several electrodes used during the remelt process proper are replaced during the "hot topping" phase by a single electrode. This results in an appreciable change in the width/depth ratio of the melt pool.

Since the single "hot topping" electrode is located in the ingot axis, the boundary zones of the ingot are subject to more intensive cooling. Allowance must be made for the fact that the temperature gradient curve within the ingot surface, because of the better thermal conductivity of the metal, is much steeper than that inside the liquid slag. This is of particular significance because the slag above the ingot end is in the molten state for quite some time, and there is the danger that it may run through out the annular gap between mold and ingot.

Accordingly, it is an object of the present inventin to modify and improve a device of the initially described type in such a way that breakthroughs or flowout of liquid slag or molten metal is prevented.

Another object of the present invention is to provide an arrangement of the foregoing character which is simple in design and construction, and economical in operation.

SUMMARY OF THE INVENTION

The objects of the present invention are achieved by providing that several blocking elements, moveable in the direction toward the ingot surface, are distributed below the mold bottom edge along the periphery of the mold. The edges or surfaces of these bolcking elements facing the ingot are adapted to the shape of the ingot cross section.

The device, according to the present inventin, can be used in the following manner. The danger of slag or metal breakthrough during the melting phase before the "hot topping" is relatively small and, as evident from experience, "run-outs" hardly occur. Hence it suffices to hold the device, according to this invention, ready for operation and, at the first sign of danger, to bring it up to the ingot by automatic control devices or by hand. It is recommended that the blocking elements be brought in contact with the ingot, only during the "hot topping" phase. It is, of course, also possible to have the blocking elements in contact with the ingot during the entire remelting process.

It is expedient to provide elastic elements between the blocking elements and their associated drives. At the same time, one may use a drive with inherent elasticity, as, for example, a pneumatically actuated pressure cylinder. The result is that even with unevenness in the ingor surface, the blocking elements are in contact with the ingot surface so that the outflow of slag and/or metal stops at the latest when the blocking elements are contacted. In this manner, the outflow of the above matter into the space below is safely prevented so that the crystallization process can come to an end without endangering operating personnel and the device.

The number of blocking elements can be varied within wide limits. However, with an increased number of blocking elements, deviations from the regular geometric shape of the ingot can be compensated more easily without unallowable wide gaps appearing elsewhere. For an ingot of circular cross section, eight blocking elements have been found to be expedient and sufficient. The blocking elements are shaped as sectors of an annular ring. The air gaps between the individual sectors are dimensioned in such a way that the sectors can be moved slightly beyond the minimum ingot diameter in the direction of the ingot axis. Narrow air gaps do not in any way impair the effectiveness of the present invention. The sectors of an annular ring, as far as their effectiveness is concerned, constitute a blocking ring sufficiently sealing against possible breakthrough of melted metal. For the manufacture of rectangular or square ingots, four blocking elements are sufficient; the corner points of the blocking elements must be provided with a certain overlap.

In accordance with an extension of this invention, it is expedient that the drive elements and the support of the blocking elements be fastened to the mold. As a result, provision of a support frame or a mounting platform in the narrow space between the mold bottom edge and mold bottom becomes superfluous. In order to save space, the drive elements may be located parallel to the mold axis. A transmission of the drive movement parallel to the axis to the radial direction of motion of the blocking elements, is accomplished by transmission angles. By fastening the blocking elements or supporting them on the mold, the gaps necessary for the movement can be reduced to a minimum.

The effectiveness of the present invention is already guaranteed when the blocking elements are made solid and have a certain thermal capacity. However, especially when producing large-size ingots, it is expedient to make the blocking elements hollow and to provide them with connections for a cooling agent. In this manner, the blocking elements can be kept to a temperature which is essentially equal to the ambient temperature. Possible liquid breakthroughs, upon contact with the cooled blocking elements, are immediately stopped by solidification and thus increase the sealing action.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
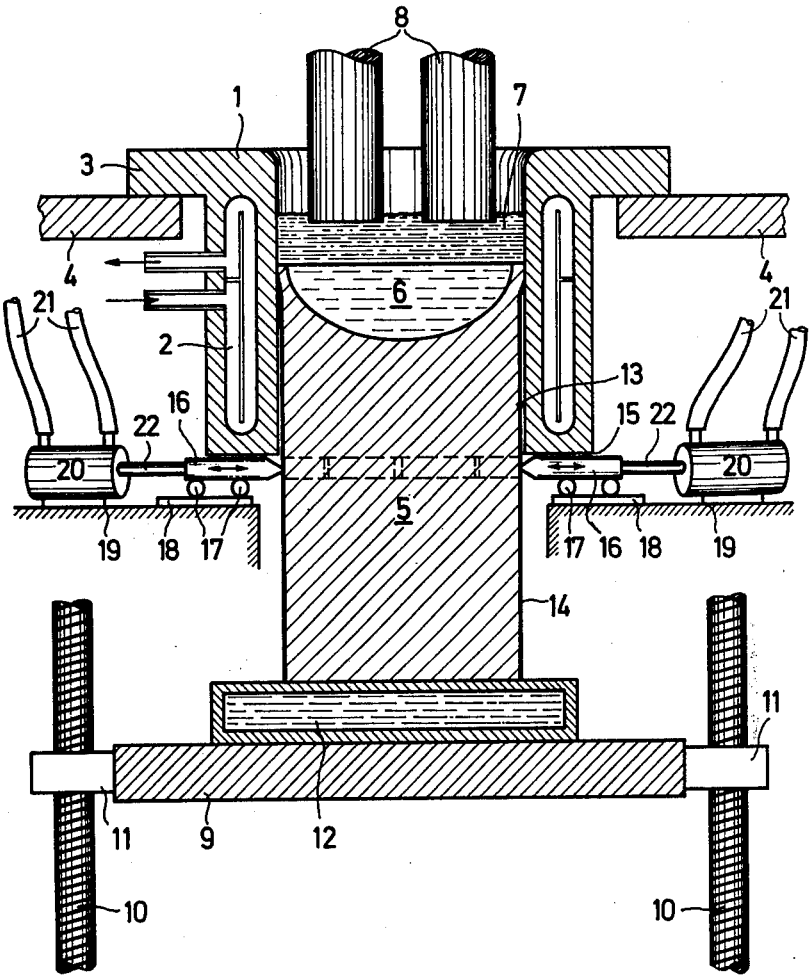
FIG. 1 is a vertical sectional view through an electroslag remelting device during the remelting process or the ingot build-up through several melt-off electrodes, in accordance with the present invention.

In FIG. 1, a liquid-cooled mold 1 is made of copper—with a hollow space 2 through which liquid flows. The mold rests with its flange 3 on a fixed furnace frame 4; further details are omitted for the sake of clarity. The device is shown in a phase immediately before terminating the remelting process during which ingot 5 was formed. The upper end of ingot 5 contains a melt pool of liquid metal 6, on top of which a slag layer 7 floats. Two melt-off electrodes 8, connected to a power source, are immersed in the slag layer. Neither the power source nor the electrode clamping device are subjects of this invention and are, therefore, omitted for the sake of clarity.

The melt-off electrodes 8 are remelted through the slag layer 7 to the melt pool 6 and consequently into ingot 5. Because of the resulting continuous change of the masses of electrodes and ingot, both ingot and electrodes have relative freedom of motion. After its crystallization, ingot 5 is subject to increasing contraction. As a result, an annular gap 13 progressively increasing in the vertical direction, is formed between ingot 5 and mold 1. This annular gap is at least partially filled with solidified slag which covers ingot 5 with a slag layer 14 and remains adhering to the ingot. During the normal remelt phase, the slag layer 14 supports the seal between mold 1 and ingot 5.

For the purpose of lowering ingot 5, it rests on a supporting frame 9. This supporting frame can be moved up and down by means of worm-gear spindles 10 and spindle nuts 11. On the supporting frame 9 there rests a mold bottom 12. At the start of the remelt process, this mold bottom tightly seals the bottom side of mold 1.

Below the mold bottom edge 15, there are distributed along the periphery of mold 1, several blocking elements 16 which can be displaced in the direction toward the ingot surface. The edges and surfaces facing the ingot are adapted to the shape of the ingot cross section. The blocking elements 16 are supported by means of rollers 17 on guide rails 18. These guide rails are part of an additional furnace frame 19.

On the furnace frame 19, for each of blocking elements 16, an associated drive element 20 in the form of a pneumatic cylinder is located. Compressed air is supplied through lines 21. Transmission of the piston movement of drive element 20 to the associated blocking element 16 is accomplished by a push rod 22. As already described, it is also possible to guide blocking elements 16 and to fasten drive elements 20 along the mold 1. However, then the push rods 20 must be angular transmission levers. In this case, the furnace frame 19 can be dispensed with.

Figure 2:
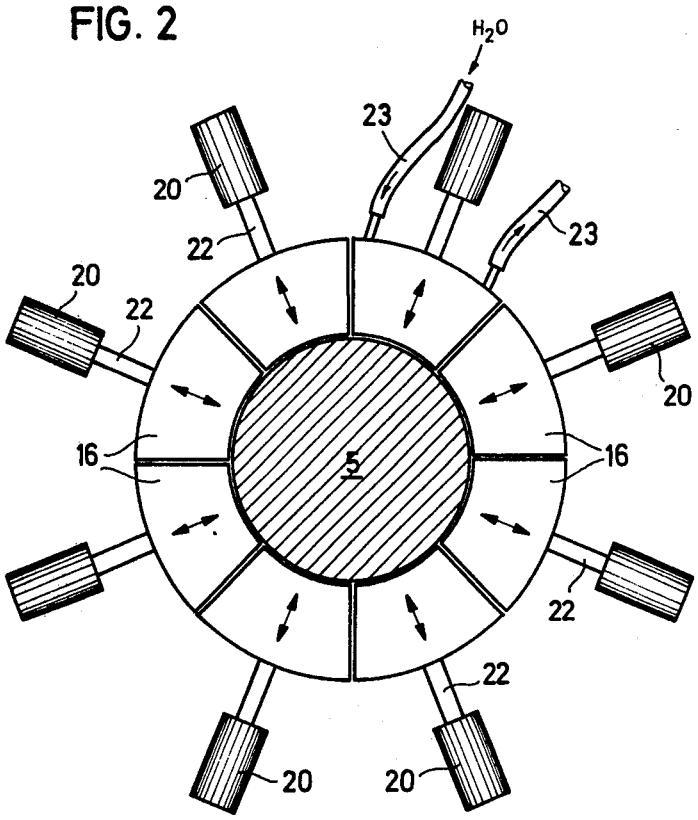
FIG. 2 is a sectional view through the device in accordance with FIG. 1 parallel to the mold bottom edge, or, a top view of the individual blocking elements and their driving elements.

In FIG. 2, identical parts, as in FIG. 1, are provided with identical designators, so that repetition here is superfluous. It is also evident that blocking elements 16 are constructed as sectors of an annular ring, and are combined into an annular ring, as far as their spatial position is concerned. The direction of motion of the blocking elements is indicated by the arrows shown. This, in turn, indicates that the drive elements also must be directed radially in relation to the ingot axis. It is also evident that, because of the circular cross section of ingot 5, the edges facing the ingot are adapted to the shape of the ingot cross section, i.e., have the radius of the ingot to be produced. In the Figure only one of the blocking elements 16 is shown with connections 23 for a cooling agent (water). It is to be understood that connections 23 are also provided for the remaining blocking elements, and that blocking elements 16 extend radially in such a way that the annular gap between the ingot surface and the hollow space in the mold is tightly sealed. An expedient overlap between the blocking elements and the mold bottom edge is provided.

Whereas the drawings show a remelt process with two melt-off electrodes, the invention's principle is not necessarily confined to a certain number and type of electrodes. It can also be successfully used with permanent electrodes and piecemeal charging, and for pouring the metal into the mold in the liquid state.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for continuous production of metal ingots by progressive crystallization below a slag layer in a mold comprising, in combination, a mold having an open bottom; and a plurality of blocking elements immediately below the bottom edge of the mold and distributed along the periphery of the mold, said blocking elements being moveable in the direction of the ingot surface, the edges and surfaces of said blocking elements facing the ingot being adapted to the shape of the ingot cross section, an annular gap prevailing between the ingot surface and the hollow space in the mold, said annular gap being substantially tightly sealed by said blocking elements.

2. The arrangement as defined in claim 1 wherein said blocking elements comprise sectors of an annular ring.

3. The arrangement as defined in claim 1 including driving means for driving said moveable blocking elements in the direction of said ingot surface; and support means for supporting said blocking elements.

4. The arrangement as defined in claim 1 including cooling means connected to said blocking elements for cooling said blocking elements, said blocking elements having hollow bodies for conducting cooling agent from said cooling means therethrough.

5. The arrangement as defined in claim 4 wherein said cooling agent comprises water.

6. The arrangement as defined in claim 1, wherein said blocking elements are moveable in the direction transverse to the longitudinal axis of the ingot.

7. The arrangement as defined in claim 1 including means for cooling said mold.

8. The arrangement as defined in claim 1 including roller means on which said blocking elements are moveable; and guide rail means for guiding said roller means.

9. The arrangement as defined in claim 3 wherein said driving means for said blocking elements comprises pneumatic cylinder means.

10. The arrangement as defined in claim 1 wherein said blocking elements extend radially so that an annular gap between the ingot surface and the interior wall of said mold is substantially sealed.

11. The arrangement as defined in claim 1 including driving means for driving said moveable blocking elements in the direction of said ingot surface; and support means for supporting said blocking elements, said blocking elements comprising sectors of an annular ring; cooling means connected to said blocking elements for cooling said blocking elements, said blocking elements having hollow bodies for conducting cooling agents from said cooling means therethrough, said cooling agent comprising water, said blocking elements being moveable in the direction transverse to the longitudinal axis of the ingot; means for cooling said mold; roller means on which said blocking elements are moveable; and guide rail means for guiding said roller means, said driving means for said blocking elements comprising pneumatic cylinder means, said blocking elements extending radially so that an annular gap between the ingot surface and the interior wall of said mold is substantially sealed.

* * * * *